US008887941B2

(12) United States Patent
Heintzman

(10) Patent No.: US 8,887,941 B2
(45) Date of Patent: Nov. 18, 2014

(54) TRASH CAN LINER SYSTEM

(76) Inventor: Kevin A. Heintzman, Oceanside, CA (US)

( * ) Notice: Subject to any disclaimer, the term of this patent is extended or adjusted under 35 U.S.C. 154(b) by 0 days.

(21) Appl. No.: 13/356,278

(22) Filed: Jan. 23, 2012

(65) Prior Publication Data

US 2013/0186900 A1 Jul. 25, 2013

(51) Int. Cl.
*B65D 25/14* (2006.01)
*B65F 1/02* (2006.01)
*B65F 1/06* (2006.01)

(52) U.S. Cl.
USPC ..... 220/495.07; 220/495.06; 220/495.08; 220/495.1

(58) Field of Classification Search
CPC ..... B65D 24/14; B65F 1/002; B65F 1/062
USPC ..... 220/495.07, 495.09, 495.08, 495.1, 220/495.06; 206/554; 383/37, 9
See application file for complete search history.

(56) References Cited

U.S. PATENT DOCUMENTS 4,182,455 A * 1/1980 Zurawin ..... 211/85.18
4,189,049 A 2/1980 Silver
4,477,950 A * 10/1984 Cisek et al. ..... 24/30.5 P
4,722,376 A * 2/1988 Rhyner ..... 150/147
5,119,968 A * 6/1992 Palmer ..... 221/26
5,575,393 A * 11/1996 Gebhardt ..... 206/554
5,598,942 A * 2/1997 Cowie ..... 220/495.08
5,788,080 A * 8/1998 Sill et al. ..... 206/554
5,803,299 A * 9/1998 Sealy, Jr. ..... 220/495.07
5,915,584 A * 6/1999 Sposit et al. ..... 220/495.09
5,966,741 A * 10/1999 Klecina ..... 2/169
6,174,848 B1 * 1/2001 Dawson et al. ..... 510/297
2004/0182866 A1 * 9/2004 Carrillo ..... 220/495.06
2007/0235455 A1 * 10/2007 Goldberg ..... 220/495.07
2007/0235456 A1 * 10/2007 Tamez ..... 220/495.07
2009/0145792 A1 * 6/2009 Lewis et al. ..... 206/391
2009/0194532 A1 * 8/2009 Yang et al. ..... 220/211
2010/0072213 A1 * 3/2010 Boyd ..... 220/630

* cited by examiner

*Primary Examiner* — Fenn Mathew
*Assistant Examiner* — Don M Anderson
(74) *Attorney, Agent, or Firm* — Gordon & Rees LLP

(57) ABSTRACT

A trash can liner system, having: a trash can (or a cage inserted into a trash can) having a first fastener on its inner surface; and a plurality of nested liners suspended together within the trash can, wherein the plurality of nested liners comprises an outer liner, wherein the outer liner has a second fastener on its outer surface, and wherein the first fastener and the second fastener are connected together thereby connecting the outer surface of the outer liner to the inner surface of the trash can.

2 Claims, 6 Drawing Sheets

TRASH CAN LINER SYSTEM

TECHNICAL FIELD

The present invention relates to garbage bags and garbage cans.

BACKGROUND OF THE INVENTION

The open top of a standard garbage bag is typically pulled up and fitted loosely over the top end of the garbage can and then filled with trash. This approach has many disadvantages. For example, depositing a large volume of trash into the can all at once can simply cause the bag to be pulled down into the can. This then requires a user to then fish the top end of the garbage bag out of the can. Second, having the loose folded top edge of the garbage bag hanging over the top of the can invites children and pets to pull on the edge, thus partially pulling the garbage bag out of the can, presenting both choking and spilling hazards. It also looks ugly, and typically smells bad. In addition, it also presents a health hazard as the dirty edges of the bag can harbor germs It would instead be desirable to provide an improved trash can system which is clean and easy to operate. It would be most desirable to not have to re-position a new bag liner in the trash can every time another liner is removed. It would also be desirable to avoid the problems of garbage bags themselves falling into the trash can either due to fumbling during set up or due to users having to reach down to the bottom of the trash can to retrieve the next garbage bag (after another one has been removed). It would also be desirable that the garbage bags be quickly and easily removable.

SUMMARY OF THE INVENTION

The present invention provides an improved trash handling system. The present system includes a plurality of removable liners positioned together in a garbage can. Mechanisms are provided such that the liners can easily and cleanly be removed one by one. Another advantage of the present invention is the fact that liners are not pulled down into the can when trash is deposited therein. Yet another advantage of the present invention is that the liners do not stick out of the top of the trash can. This feature makes the present invention visually appealing and safe for pets and children. Additionally, optional markings can be included on the liners to tell the user when (s)he is approaching the end of the liners (such that the user may order more liners from a supplier).

In a preferred embodiment, the present invention provides a trash can liner system, comprising: a trash can having a first fastener on its inner surface; and a plurality of nested liners suspended together within the trash can, wherein the plurality of nested liners comprises an outer liner, wherein the outer liner has a second fastener on its outer surface, and wherein the first fastener and the second fastener are connected together thereby connecting the outer surface of the outer liner to the inner surface of the trash can.

In another embodiment, a cage is inserted into the trash can. In this embodiment, the cage has the first fastener on its inner surface and the plurality of nested liners are suspended together within this cage.

DETAILED DESCRIPTION OF THE DRAWINGS

Figure 1:
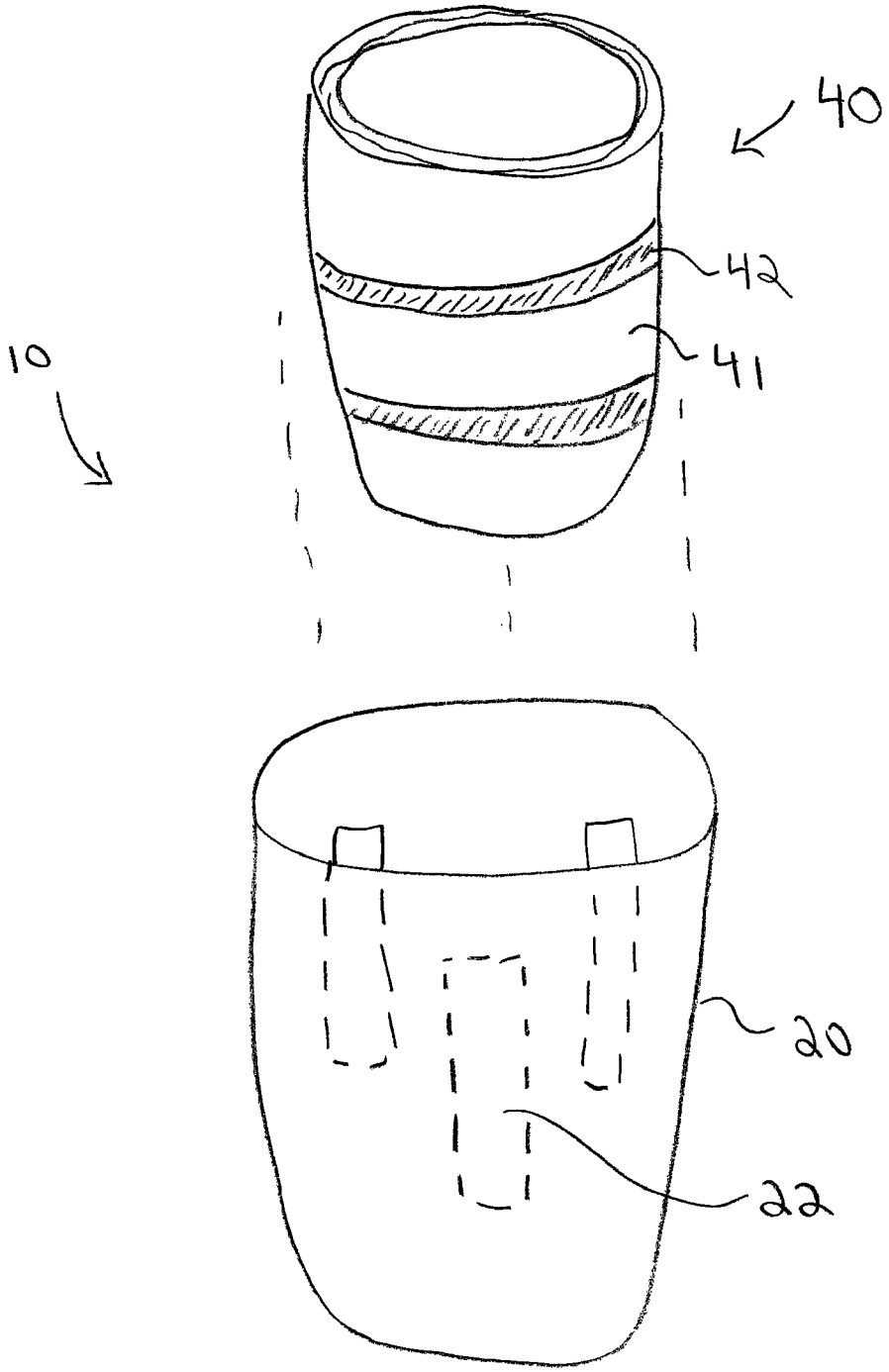
FIG. 1 is an exploded perspective view of a first embodiment of the present invention.
Figure 2:
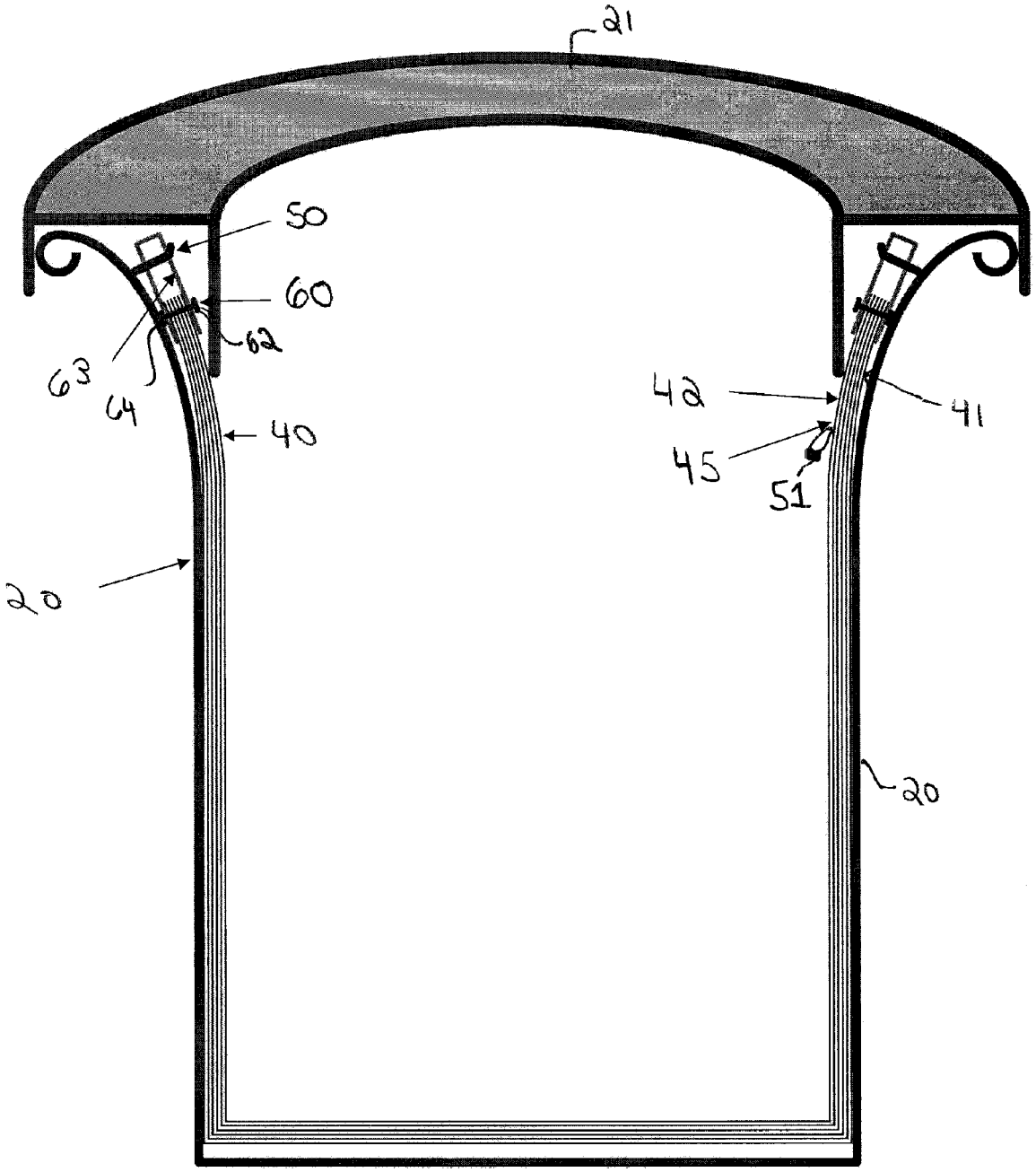
FIG. 2 is a sectional elevation view of the first embodiment of the present invention.
Figure 3:
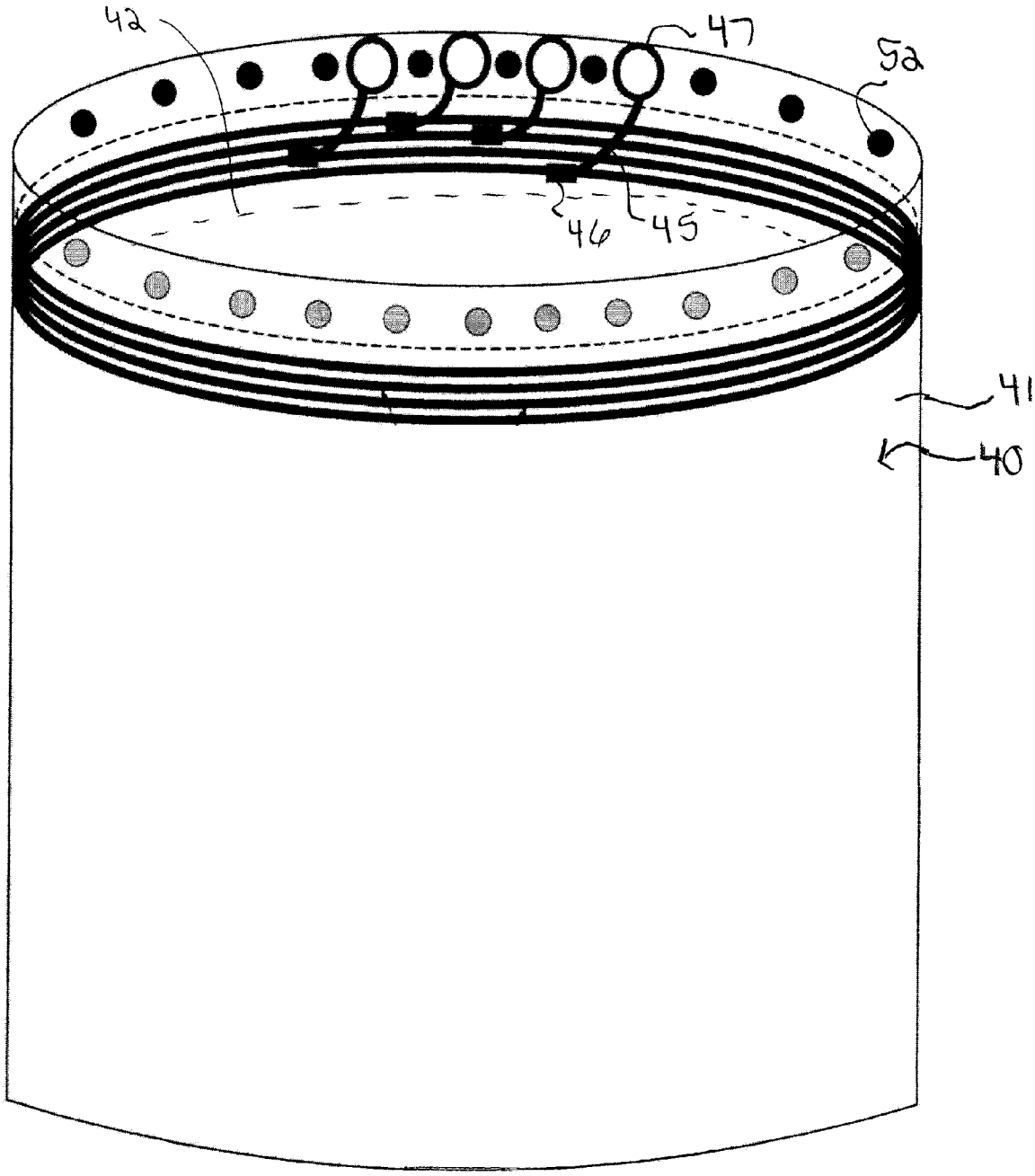
FIG. 3 is a perspective view showing a plurality of nested liners.
Figure 4:
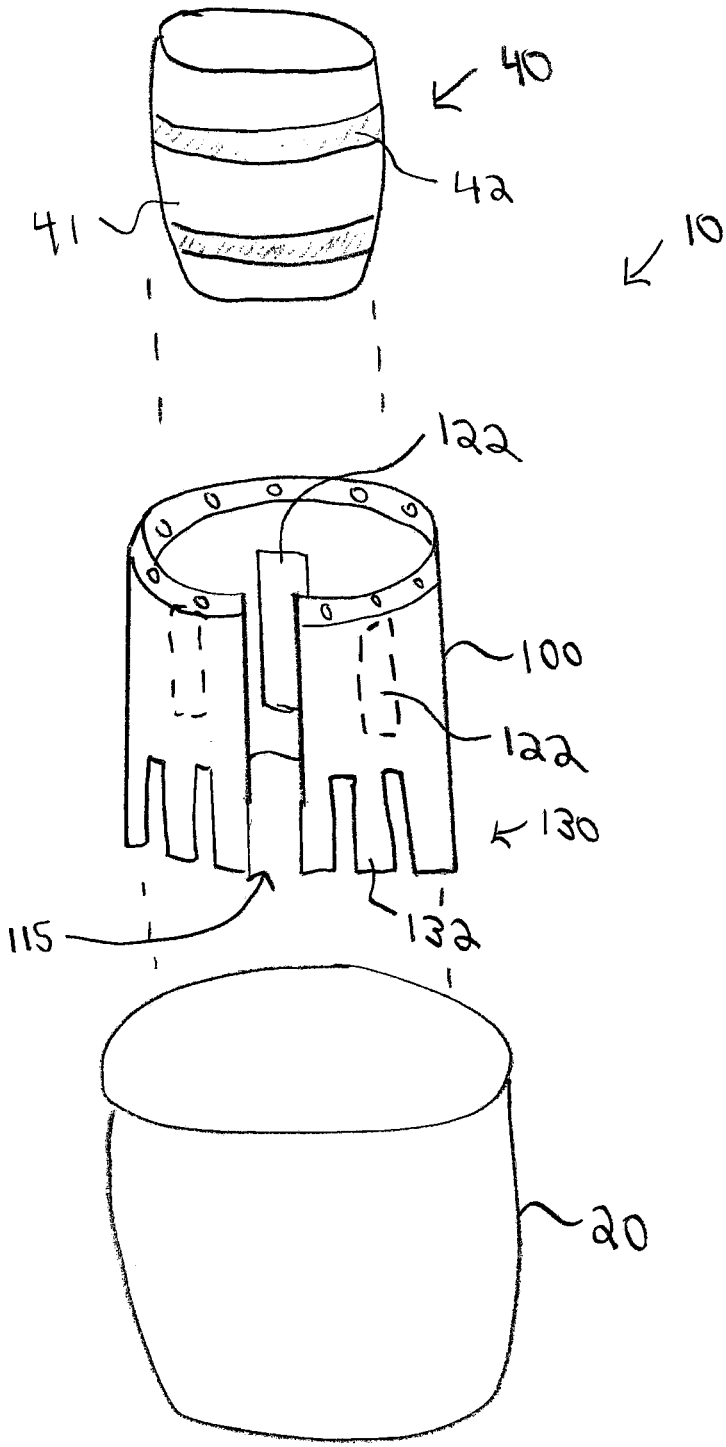
FIG. 4 is an exploded perspective view of a second embodiment of the present invention, incorporating a trash cage inserted between the trash can and the plurality of nested liners.
Figure 5:
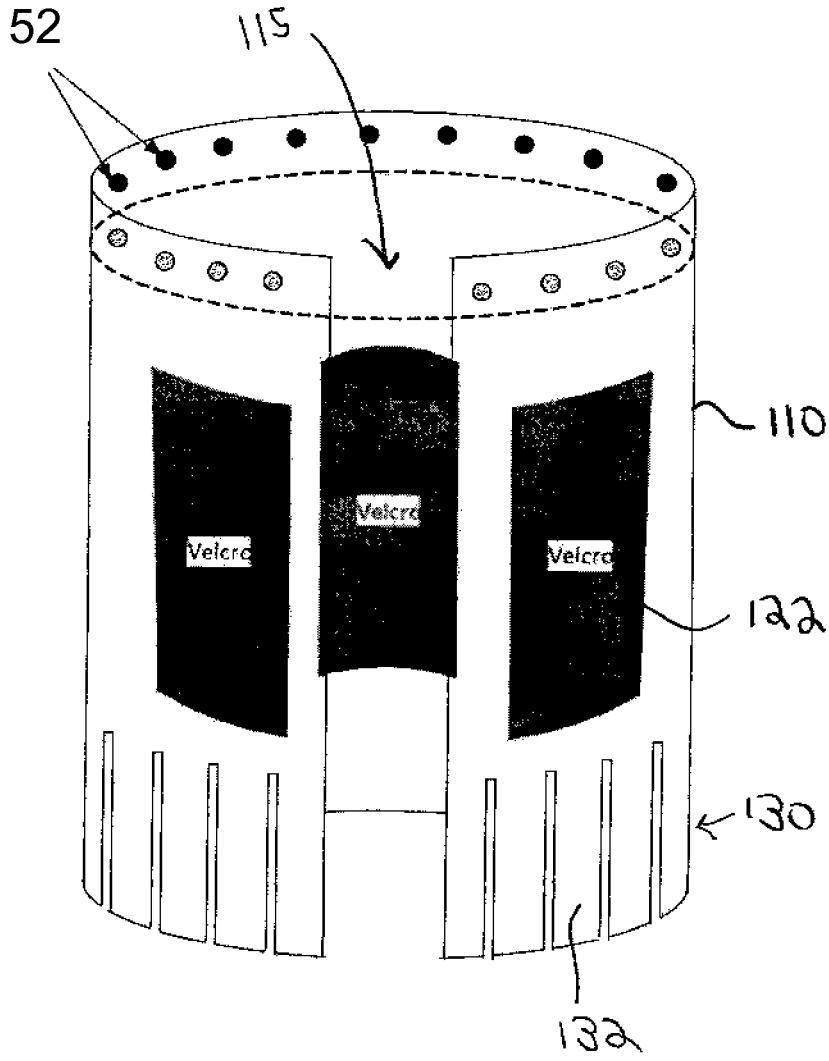
FIG. 5 is a perspective view of an expandable trash cage in accordance with a second embodiment of the invention.
Figure 6:
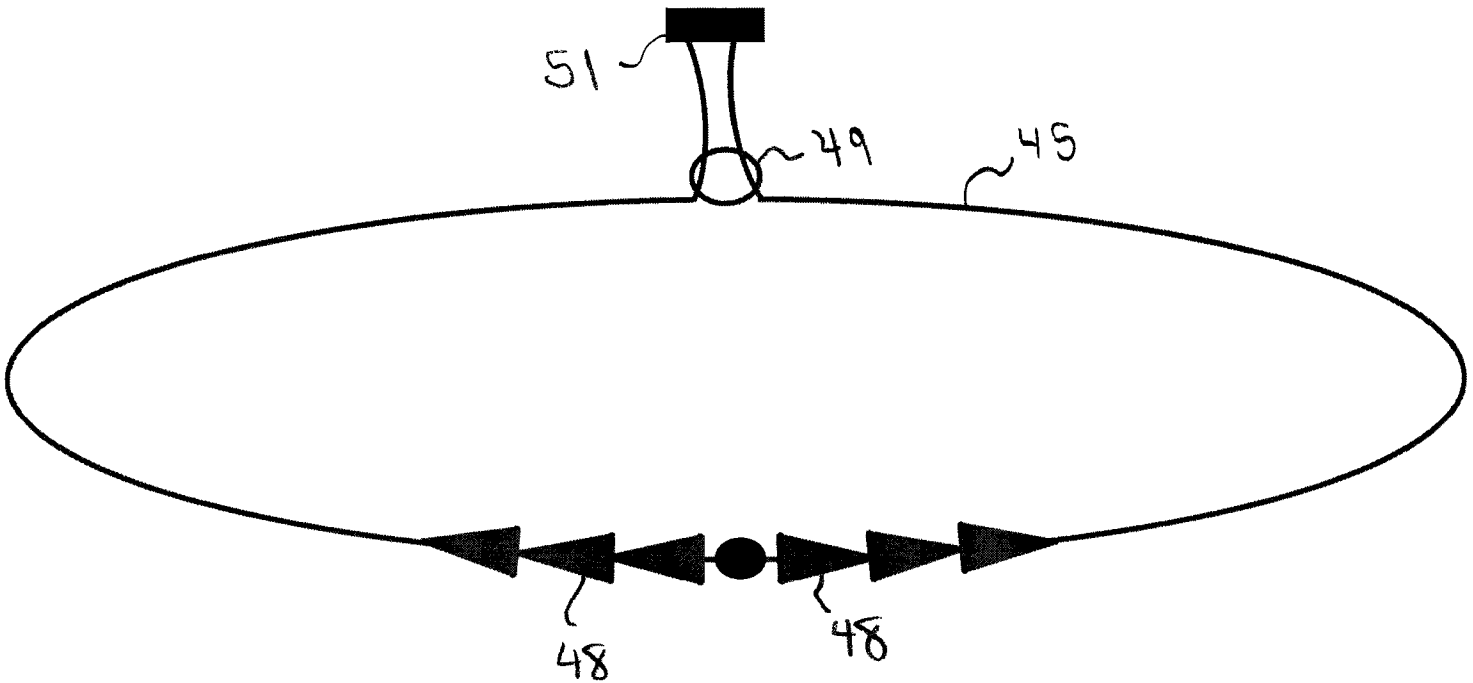
FIG. 6 is an illustration of a preferred bag closure mechanism.

FIGS. 1 and 2 show a first embodiment of the invention in which a plurality of nested liners are inserted directly into a trash can. FIGS. 4 and 5 show a second embodiment of the invention in which a trash cage is inserted between the trash can and the plurality of nested liners. FIG. 3 shows a plurality of nested liners that can be used with either embodiment of the present invention. FIG. 6 shows a mechanism for closing each of the successive bags.

Turning first to FIG. 1, a trash can liner system 10 is provided. System 10 comprises: a trash can 20 having first fasteners 22 on its inner surface; and a plurality of nested liners 40 suspended together within trash can 20. The plurality of nested liners 40 comprises an outer liner 41 having a second fastener (or fasteners) 42 on its outer surface. In operation, nested liners 40 are inserted together into trash can 20. The first fastener 22 and the second fastener 42 connect together, thereby holding the outer surface 41 of the outer liner 40 to the inner surface of trash can 20.

In preferred embodiments, first and second fasteners 22 and 42 are hook-and-loop (e.g.: Velcro®) connectors. It is to be understood, however, that the present invention encompasses any other suitable fastening system. Optionally, first fasteners 22 are vertical strips of hook-and-loop material and second fasteners 42 are horizontal strips of hook-and-loop material, as shown. As a result, when the stack of nested liners 40 are placed into trash can 20, horizontal Velcro® strips 42 will stick to vertical Velcro® strips 22. This has the advantage of both holding liners 40 in place and of keeping them "fully open" in the trash can. This avoids the nasty effect of placing trash into a garbage bag that has not yet been fully opened. (Specifically, the problem of the not-fully-opened bag being pulled down into the trash can when being loaded).

FIG. 2 shows a sectional side elevation of the assembled device of FIG. 1. (Note: in FIG. 2, the top of the garbage can is "fluted" outwards. This has the advantage of ensuring an easy removal of the liner, even when the bag is overstuffed. It is to be understood that the present invention encompasses designs where the top end of the garbage can is fluted outwards, and those where it is not. As can be seen, a plurality of connectors 50 is provided to hold the top of the stacked liners 40 within trash can 20. Connectors 50 are provided around the circumference of liners 40 and trash can 20 such that the top ends of the liners 40 are snapped into position around the top inside surface of trash can 20. Thus, connectors 50 hold the open top end of liner stack 40 in a fully open position. An additional advantage of connectors 50 is that liner stack 40 can be held in position fully within trash can 20. Thus, there is no trash bag top end sticking out (and wrapping around the top) of the trash can 20. This provides added safety for pets and small children, and avoids people seeing the ugly, loose top end of the garbage bag. Moreover, an optional top 21 can cover the garbage can, as shown.

In one optional embodiment, each connector 50 may be a snap connector having a first part disposed around the inner top edge of the trash can, and a second part disposed around the outer top edge of the outer liner, such that the plurality of nested liners are suspended inside trash can 20 by the snap connectors when the first and second parts of the snap connectors are snapped together. Alternatively, connector 50 may simply comprise a projection onto which liners 40 are hung (as seen in FIG. 2).

Also included are optional support fasteners 60 for holding together the plurality of nested liners 40. Support fasteners 60 pass through the plurality of nested liners 40 near their top ends. As a result, the plurality of nested liners 40 are connected together near their top ends. A cardboard section 63 may also be used to hold the liners together. Preferably, each support fastener 60 comprises an elongated member 61 having opposite blunt ends 62 and 64. Elongated member 61 passes through small holes in nested liners 40 with opposite blunt ends 62 and 64 being disposed inside and outside of the plurality of nested liners, respectively. Support fastener 60 may optionally be a standard tag fastener that is typically used to attach price tags to clothing at retail stores. Other mechanisms may also be used.

In operation, a first (innermost) liner is filled with trash. When full, it is removed. In preferred embodiments, each of the plurality of nested liners 40 will have perforations 42 adjacent to their top ends to permit them to be removed in succession. As each successive liner 40 is removed, it will be separated via pulling the innermost liner at perforation line 42 from the liner pack. The process is repeated such that liners 40 are used in succession. Finally, after all of the inner liners in the liner stack have been removed, only liner 41 will remain. In accordance with the present invention, the inside of liner 41 may be marked with a "Re-Order More Liners" message/logo that becomes visible when the second to last liner is removed.

Referring next to FIG. 3, each liner 40 preferably includes a cable tie (or other suitable closure mechanism) 45 surrounding an open top end of each of the nested liners. Preferably, the cable tie 45 will pass through holes or perforations around the open top ends of each of the nested liners. Cable tie 45 can be made of any suitable material including, but not limited to, wires or monofilament fibers (including fishing line materials).

Cable tie 45 may optionally comprise a slip-through mechanism 46 and terminates with a finger loop 47. As will be shown, however, other closure systems are also encompassed within the scope of the present invention. This is very convenient to use since the person simply puts a finger through finger loop 47 of the innermost liner and pulls. When this occurs, cable tie 45 will tighten the top end of the innermost liner. At the same time, this innermost liner will pull over blunt ends 62 of support fasteners 60. Another preferred closing mechanism is seen in FIG. 6 where closure mechanism 45 instead includes opposite jousts 48, ring 49 and finger catch 51. The portion of closure mechanism 45 between ring 49 and jousts 48 is sewn or threaded into each bag 40 and the portion of cable tie 45 between ring 49 and finger catch 51 hangs inside the bag. In operation, the user pulls on finger catch 51, drawing closure mechanism 45 through ring 49 until opposite jousts 48 pass through ring 49 and are locked in place.

Returning to FIGS. 4 and 5, a second embodiment of the invention is shown in which a cage 100 is inserted between trash can 20 and liner stack 40. The difference between the embodiment of FIGS. 1/FIG. 2 and FIG. 4/FIG. 5 is that in the first embodiment in FIG. 1/FIG. 2 has first fasteners 22 on the inside of trash can 20, whereas in the second embodiment in FIG. 4/FIG. 5, first fasteners 122 are instead on the inside of cage 100.

Specifically, cage 100 has first fasteners 122 that connect to second fasteners 42. This holds liners 40 in position in cage 100. Cage 100 is then inserted into trash can 20. The advantage of this approach is that cage 100 can be used with different trash can designs. Moreover, it can simply be placed into a user's existing trash can. Thus, it is not necessary to buy a new trash can to practice the present invention.

In optional aspects, cage 100 has an inwardly tapered bottom 130. Inwardly tapered bottom 130 may be formed by cage 100 having spaced apart bottom slats 132. Thus, when inserted into a trash can 20 that has a narrow bottom, slats 132 can be pushed together making the bottom of cage 100 narrower. Optionally, cage 100 may be made of styrene, or any other suitable material.

As can also be seen, cage 100 may have a side opening 115. Thus cage 100 would optionally substantially but not fully around the inner circumference of trash can 20. This would permit cage 100 to be designed such that it flexes outwardly against the inner surface of the trash can (both to make it easier to insert into the trash can, and to accommodate trash cans of different size.

The connectors 50 and support fasteners 60 operate exactly the same as described above in FIGS. 1 and 2, with the only difference being that cage 100 holds nested liners 40 (instead of trash can 20 directly holding nested liners 40).

In an optional embodiment of the invention, the liners 40 may be folded back upon themselves, allowing for increased bag capacity.

What is claimed is:

1. A trash can liner system comprising:

a trash can having an inside surface and an upper opening to receive trash;

a plurality of connectors fixedly mounted and evenly distributed completely around the inner surface of the trash can opening, each of the connectors being, rigid, rod shaped, located adjacent the opening and directed inwardly with the inward end of each connector being bent in a direction towards the trash can opening;

a liner packet having a plurality of nested liners, a plurality of supports and an upside down U shaped in cross section liner holder;

each liner of the plurality of nested liners is successively and wholly contained within the preceding liner until the plurality of nested liners includes an innermost liner and an outermost liner, the plurality of nested liners having an open end;

the plurality of supports, each support having a shaft with an inner blunt end and an outer blunt end, the shaft passing through the plurality of nested liners and the plurality of supports being evenly distributed completely around and adjacent the open end of the nested liners, the inner blunt end inside the inner liner and the outer blunt end outside the outer liner;

the upside down U-shaped liner holder being annular with an inside downwardly extending arm and an outside downwardly extending arm, the liner holder mounted completely around and over the open end of the nested liners, the plurality of shafts of the supports passing through the inside arm and the outside arm with the inside blunt end being inside the inside arm and the outside blunt end being outside the outside arm;

each of the plurality of nested liners includes a tear line completely around the open end below the supports so that each of the liners may be removed in succession;

a tie surrounding the open end of each of the liners below the tear line, each tie includes a slip through lock with a finger catch whereby to facilitate removal of each of the liners in succession;

the liner holder having a plurality of mounting sites distributed completely around the upper closed end of the toroidal upside down U-shaped holder, the mounting sites corresponding to the locations of the connectors, the mounting sites being a tight fit opening to removably receive and secure the respective connectors whereby the nested liner packet is retained within the trash can.

2. A liner packet for use with a trash can comprising:

a plurality of nested liners, a plurality of supports and an upside down U-shaped in a cross section liner holder;

each of the plurality of nested liners is successively and wholly contained within the preceding liner until the plurality of nested liners includes an innermost liner and an outermost liner, the plurality of nested liners having an open end;

the plurality of supports, each support having a shaft with an inner blunt end and an outer blunt end, the shaft passing through the plurality of nested liners and the plurality of supports being evenly distributed completely around and adjacent the open end of the nested liners, the inner blunt end inside the inner liner and the outer blunt end outside the outer liner;

the upside down U-shaped liner holder being annular with an inside downwardly extending arm and an outside downwardly extending arm, the liner holder mounted completely around and over the open end of the nested liners, the plurality of shafts of the supports passing through the inside arm and the outside arm with the inside blunt end being inside the inside arm and the outside blunt end being outside the outside arm;

each of the plurality of nested liners includes a tear line completely around the open end below the supports so that each of the liners may be removed in succession;

a tie surrounding the open end of each of the liners below the tear line in each of the ties including a slip through lock with a finger catch whereby to facilitate removal of each of the liners in succession;

the liner holder having a plurality of mounting sites distributed completely around the upper closed end of the toroidal upside down U-shaped holder, the mounting sites adapted to corresponding to the locations of connectors, the mounting sites being a tight opening to removably receive and secure the respective connectors whereby the nested liner packet is retained within the trash can.

* * * * *